United States Patent [19]

Tuckey et al.

[11] 4,394,852

[45] Jul. 26, 1983

[54] COWL MOUNTED PULSE CONTROL START VALVE

[75] Inventors: Charles H. Tuckey, Cass City; Alan D. Romig, Gagetown, both of Mich.

[73] Assignee: Walbro Corporation, Cass City, Mich.

[21] Appl. No.: 264,787

[22] Filed: May 18, 1981

[51] Int. Cl.[3] ..... F02M 1/16

[52] U.S. Cl. ..... 123/187.5 R; 123/179 G; 123/DIG. 5; 251/246

[58] Field of Search ..... 123/187.5 R, DIG. 5, 123/179 G; 251/246, 244

[56] References Cited

U.S. PATENT DOCUMENTS

| | | | |
|---|---|---|---|
| 1,231,124 | 6/1917 | Brown | 123/187.5 R |
| 2,019,257 | 10/1935 | Gibbs | 251/246 |
| 2,302,306 | 11/1942 | Faast | 251/246 |
| 3,983,857 | 10/1976 | O'Connor | 123/187.5 R |
| 4,194,483 | 3/1980 | McChesney et al. | 123/187.5 R |

FOREIGN PATENT DOCUMENTS

| | | | |
|---|---|---|---|
| 426494 | 10/1947 | Italy | 251/246 |

*Primary Examiner*—Charles J. Myhre
*Assistant Examiner*—Andrew M. Dolinar
*Attorney, Agent, or Firm*—Barnes, Kisselle, Raisch, Choate, Whittemore & Hulbert

[57] ABSTRACT

A system for priming a carburetor for an internal combustion engine which includes a pulse pressure conduit leading from an engine crankcase to a significant portion of a carburetor and a cowl located manually operated valve for opening this conduit during cold starting of an engine. The valve is arranged to have at least three positive positions including "closed" and a plurality of regulated open positions.

5 Claims, 4 Drawing Figures

COWL MOUNTED PULSE CONTROL START VALVE

FIELD OF INVENTION

Carburation of internal combustion engines particularly in starting.

BACKGROUND OF THE INVENTION

In vehicles using small engines, such as snowmobiles, the problem of a cold start still persists. Manual priming has been used but this usually involves direct access to the carburetor and engine.

The present invention contemplates a system to aid the starting of a cold engine which can be controlled from the cockpit of a vehicle.

Crankcase pulse pressure in internal combustion engines has been used in connection with carburetor systems. In a United States patent to Tuckey and Schneider, U.S. Pat. No. 3,633,557, a crankcase pulse controlled by a valve in a throttle shaft is directed to an idle system to give an acceleration charge when the throttle is open.

In a United States patent to Tuckey, U.S. Pat. No. 3,738,622, a crankcase pulse is used to actuate a fuel pump and a vapor pump. In U.S. Pat. No. 3,743,254 to Tuckey, a crankcase pulse is used to pulse a special spring backed diaphragm on the dry side to deliver an acceleration charge of fuel to a main jet in the carburetor. In U.S. Pat. No. 4,104,994 to Phillips, a throttle controlled crankcase pulse is used to aspirate fuel out of the main jet to the mixing passage of the carburetor.

Thus, crankcase pulse has been utilized in the control of fuel flow from a carburetor in various applications. According to the present invention, a crankcase pulse line is carried from the engine crankcase to the cowl of a vehicle or some other readily accessible place. A valve for manual control is placed in this line which is then carried to a carburetor fuel well or diaphragm. Particular manipulation of this valve can provide suitable conditions for starting and engine operation.

Other objects and features of the invention will be apparent in the following description and claims in which the principles of the invention are set forth together with a description of the invention and a disclosure directed to persons skilled in the art to enable the use of the invention.

BRIEF DESCRIPTION OF THE DRAWINGS

DRAWINGS accompany the disclosure and the various views thereof may be briefly described as.

DETAILED DESCRIPTION OF THE INVENTION

Figure 1:
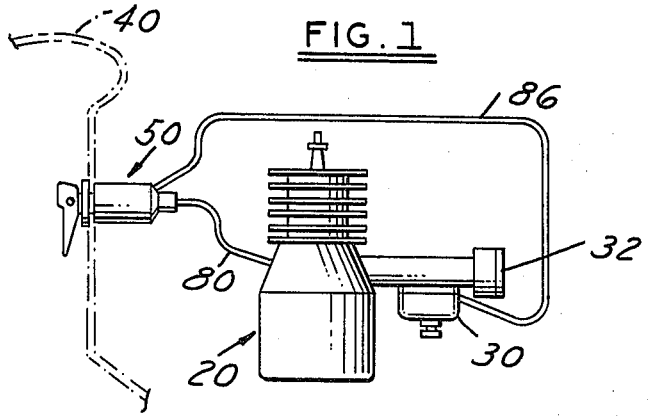
FIG. 1, a schematic view of an engine, carburetor and control valve.
Figure 3:
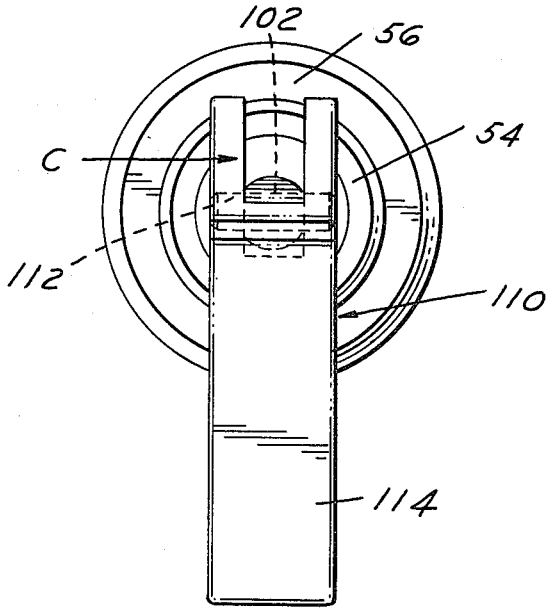
FIG. 3, an end view of the control valve.

With reference to FIG. 1, an engine 20 is shown having a carburetor 30 and an air inlet 32. The carburetor can either be a float type carburetor or a diaphragm controlled carburetor. A vehicle cowl panel 40 is illustrated in FIG. 1, and mounted in this cowl is a valve body 50 having a shoulder 52 and a threaded fore-portion 54 on which is located a threaded grommet ring 56 (FIG. 3) which clamps the cowl panel.

The valve body has a central bore 60 which ensmalls at 62. The ensmalled portion 62 terminates at a shoulder 64 surrounding a passage 66 which opens into a bore 68 having a tapered wall serving as a spring seat for one end of a compression spring 70.

A connection nipple 72 is press fitted into an axial bore enlarged from bore 68. This nipple has a valve seat 74 for a ball check 76 engaged by the other end of the spring 70.

The outer end of nipple 72 engages a conduit 80 leading to the crankcase of the engine 20. A connection nipple 82 is mounted in a bore 84 angling into the body 50 and intersecting the central bore 60. This nipple is connected by a conduit 86 to the carburetor 30. This connection can be to a fuel well in a float carburetor or to the top of the float chamber or, in a diaphragm carburetor, to the dry side of the fuel inlet control diaphragm or in other ways in which a pulse will direct a quantity of fuel to the main jet of a carburetor.

Figure 2:
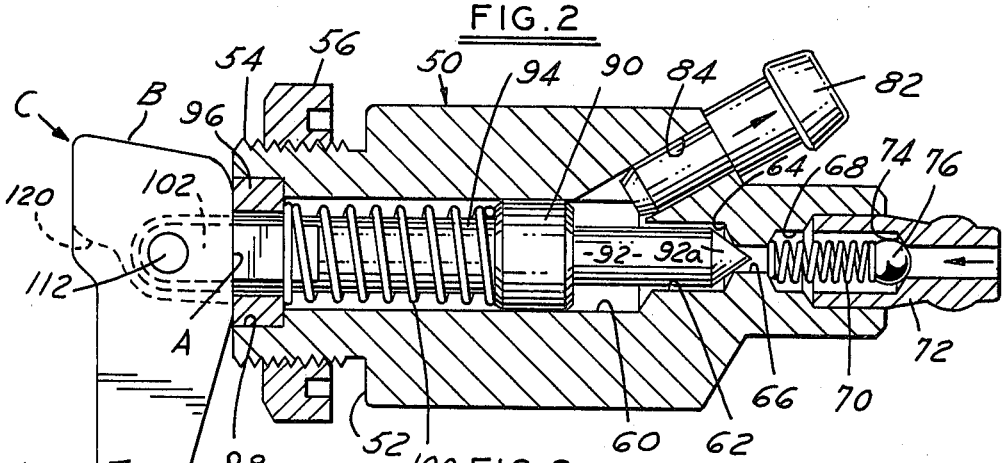
FIG. 2, a sectional view of a control valve.

As shown in FIG. 2, a valve plunger has a spool guide portion 90 slidable in bore 60 with a pointed valve projection 92 to cooperate with valve seat 64. A control projection or shank 94 extends outwardly of the bore through a bushing 96 which is press fitted into a countersunk recess 98 at the mouth of bore 60. A compression spring 100 surrounds the shank 94, one end bearing against the guide portion 90 and the other end bearing against the bushing 96. The shank has a flat extension 102 which inserts between the arms of a pivoted clevis lever 110, and a cross-pin 112 provides the pivot axis.

The clevis arm 110 has a manual lever extension 114 and, at the head end, has three surfaces spaced at different distances from the pivot center of pin 112. Flat surface A is shown in FIG. 2 to be in contact with bushing 96 and, in this position, the valve nose 92a is in a closed position relative to valve seat 64. Spring 100 holds the valve plunger to the right. When the lever arm 114 is lifted, the plunger 90 will move out and then back in as the surface B comes to rest against bushing 96.

Figure 4:
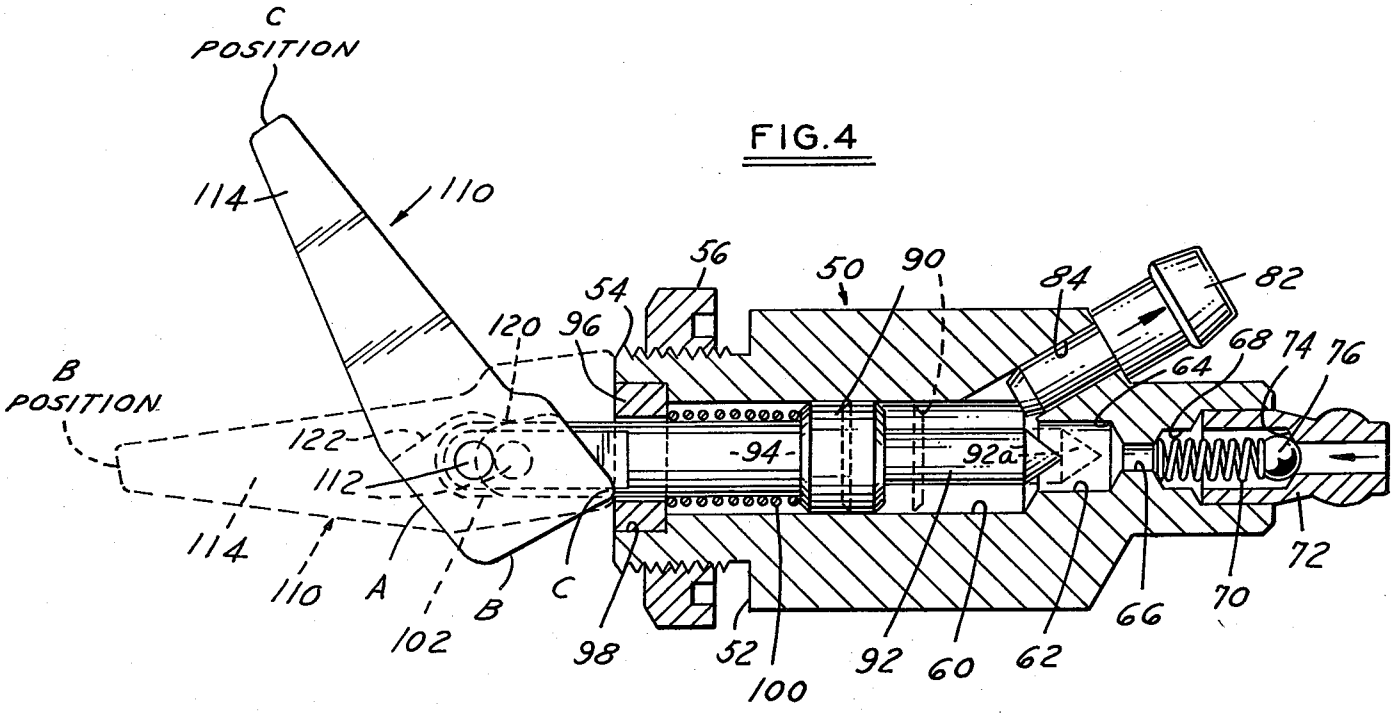
FIG. 4, a view similar to that of FIG. 2 showing alternate valve positions.

In FIG. 4, a depiction of FIG. 2 is shown with alternate positions of the lever arm 114 and valve 92 illustrated. The closed position of the valve 92 is shown in solid lines in FIG. 2. This is delineated Position "A".

In Position "B", with surface B of lever 110 against bushing 96, shown in dash lines in FIG. 4, the valve is partly open but still within the bore 62 for a "warm-up" position. In Position "C", the nose C of lever 110 is positioned against the bushing 96 as shown in solid lines in FIG. 4. In this position, the valve is open at the maximum degree with the valve stem 92 withdrawn from the bore 62. This is the desirable position for a cold start.

A stop 120 in the form of an interference shoulder is utilized to hold the lever 110 in the "cold start" position. As has been stated, the lever 110 has a top slot to receive the plunger shaft 102 which is transfixed by the pivot pin 112. See FIG. 3. As viewed in FIG. 4, it will be seen that the slot in the top of the lever has a base surface shown in dotted lines at 122. When the lever is moved to Position "C" of FIG. 4, the shoulder 120 of the surface 122 contacts the shaft 102 and blocks further movement of the lever. Since at this position, the corner C is over center, the lever 110 will remain in the stable "C" position until shifted back to Position "B" or "Position A".

The distance from the pivot center 112 to surface A may be 11 millimeters; from the center to surface B, 18 millimeters, and from center to nose C, 24 millimeters.

In starting an engine, the lever 114 is moved to Position "C" for opening valve 92A to the maximum degree, allowing pulses from the cranked engine to reach the carburetor for priming the mixing passage. When the engine fires, the lever can be moved to Position "B" for a smaller valve opening. When the engine warms up, the the valve can be moved again to the closed position to close off the engine pulses from the carburetor.

What is claimed as new is:

1. A system for priming a carburetor for an internal combustion engine which comprises:

(a) a conduit connected to the body of an engine to receive and conduct pulses from said engine, said conduit being directly connected to a carburetor having a fuel and air mixing passage operatively associated with said engine wherein pulses in said conduit will propel fuel into the mixing passage of said carburetor, (b) a valve in said conduit located remote from said engine having a manually movable part to close said conduit in one position and to open said conduit in a second position, (c) said valve comprising a valve body having a bore ensmalled at one end to provide a valve seat, and said movable part comprising a plunger slidable in and guided by said bore, and a valve element on one end of said plunger to cooperate with said valve seat, (d) said valve plunger having an actuating stem on the other end extending from said body, and an actuating lever pivoted on a first axis on said stem, a spring urging said plunger toward a valve closed position, and a plurality of surfaces on said lever spaced at respective angles around said first axis to bear selectively against said body in selected positions of said lever to control the position of said valve element relative to said valve seat, and (e) said plurality of surfaces comprising two flat surfaces lying in planes parallel to the said first axis and contiguous to a corner surface, said corner surface forming a third surface, each surface to position said valve element, respectively, in a closed position relative to said valve seat, a maximum open position, and an intermediate position.

2. A system for priming a carburetor for an internal combustion engine which comprises:

(a) a conduit connected to the body of an engine to receive and conduct pulses from said engine, said conduit being directly connected to a carburetor having a fuel and air mixing passage operatively associated with said engine wherein pulses in said conduit will propel fuel into the mixing passage of said carburetor, (b) a valve in said conduit located remote from said engine having a manually movable part to close said conduit in one position and to open said conduit in a second position, and (c) said manually movable part of said valve having an actuating stem, and an actuating lever pivoted on a first axis on said stem, a spring urging said valve to a closed position, and a plurality of surfaces on said lever spaced at respective angles around said first axis and lying in planes parallel to said first axis, said surfaces comprising two flat surfaces contiguous to a corner surface, said corner surface forming a third surface, each surface to position said valve, respectively, in a closed position, a maximum open position, and an intermediate position, upon shifting of said actuating lever.

3. A system for priming a carburetor for an internal combustion engine which comprises:

(a) a conduit connected to the body of an engine to receive and conduct pulses from said engine, said conduit being directly connected to a carburetor having a fuel and air mixing passage operatively associated with said engine wherein pulses in said conduit will propel fuel into the mixing passage of said carburetor, (b) a valve in said conduit located remote from said engine having a manually movable part to close said conduit in one position and to open said conduit in a second position, said valve comprising:

(c) a cylindrical body having a shoulder at one end and a threaded extension beyond said shoulder, a threaded grommet on said extension to mount said body on an apertured plate, said body having a central bore ensmalled at one end to form a valve seat and a first connection to said conduit, a second connection on said body for said conduit on a side of said valve seat away from said first conduit, (d) a plunger slidable in said bore having a valve extension on one end to cooperate with said valve seat and an actuator extension on the other end projecting from said bore, and (e) a lever pivoted on a first axis on said actuator extension having a plurality of plane surfaces to lie against the end of said body in selected positions of said lever to control the position of said valve extension relative to said valve seat.

4. A system for priming a carburetor for an internal combustion engine which comprises:

(a) a conduit connected to the body of an engine to receive and conduct pulses from said engine, said conduit being directly connected to a carburetor having a fuel and air mixing passage operatively associated with said engine wherein pulses in said conduit will propel fuel into the mixing passage of said carburetor, (b) a valve in said conduit located remote from said engine having a manually movable part to close said conduit in one position and to open said conduit in a second position, said valve comprising:

(c) a cylindrical body having a shoulder at one end and a threaded extension beyond said shoulder, a threaded grommet on said extension to mount said body on an apertured plate, said body having a central bore ensmalled at one end to form a valve seat and a first connection to said conduit, a second connection on said body for said conduit on a side of said valve seat away from said first conduit, (d) a plunger slidable in said bore having a valve extension on one end to cooperate with said valve seat and an actuator extension on the other end projecting from said bore, and (e) a lever pivoted on a first axis on said actuator extension having a plurality of plane surfaces to lie against the end of said body in selected positions of said lever to control the position of said valve extension relative to said valve seat, said lever having a shoulder adjacent said first axis to limit the motion of said lever in one extreme position.

5. A system for priming a carburetor for an internal combustion engine which comprises:

(a) a conduit connected to the body of an engine to receive and conduct pulses from said engine, said conduit being directly connected to a carburetor having a fuel and air mixing passage operatively associated with said engine wherein pulses in said conduit will propel fuel into the mixing passage of said carburetor, (b) a valve in said conduit located remote from said engine having a manually movable part to close said conduit in one position and to open said conduit in a second position, said valve comprising:

(c) a cylindrical body having a shoulder at one end and a threaded extension beyond said shoulder, a threaded grommet on said extension to mount said body on an apertured plate, said body having a central bore ensmalled at one end to form a valve seat and a first connection to said conduit, a second connection on said body for said conduit on a side of said valve seat away from said first conduit, (d) a plunger slidable in said bore having a valve extension on one end to cooperate with said valve seat and an actuator extension on the other end projecting from said bore, and (e) a lever pivoted on a first axis on said actuator extension having a plurality of plane surfaces to lie against the end of said body in selected positions of said lever to control the position of said valve extension relative to said valve seat, said lever having a bifurcate portion forming a slot to receive said actuator extension, the base surface of said slot being formed to contact said extension in one extreme position to limit the movement of said lever to said position.

* * * * *